United States Patent [19]

Kane

[11] Patent Number: 4,464,606

[45] Date of Patent: Aug. 7, 1984

[54] PULSE WIDTH MODULATED DIMMING ARRANGEMENT FOR FLUORESCENT LAMPS

[75] Inventor: John F. Kane, Lancaster, Pa.

[73] Assignee: Armstrong World Industries, Inc., Lancaster, Pa.

[21] Appl. No.: 433,310

[22] Filed: Oct. 7, 1982

Related U.S. Application Data

[63] Continuation-in-part of Ser. No. 247,314, Mar. 25, 1981, abandoned.

[51] Int. Cl.[3] ..... H05B 41/29; H05B 41/392

[52] U.S. Cl. ..... 315/158; 315/151; 315/224; 315/225; 315/307; 315/DIG. 7; 361/103; 363/56

[58] Field of Search ..... 315/151, 158, 291, 307, 315/119, 209 R, 224, DIG. 7, 225; 361/103; 363/50, 56; 331/62

[56] References Cited

U.S. PATENT DOCUMENTS

| | | | |
|---|---|---|---|
| 3,619,713 | 11/1971 | Biega et al. | 315/224 |
| 3,870,943 | 3/1975 | Weischedel et al. | 363/50 |
| 4,074,170 | 2/1978 | Orban | 315/120 |
| 4,170,747 | 10/1979 | Holmes | 315/224 |
| 4,236,101 | 11/1980 | Luchaco | 315/158 |
| 4,322,817 | 3/1982 | Kuster | 363/41 |

FOREIGN PATENT DOCUMENTS

| | | | |
|---|---|---|---|
| 2917256 | 11/1980 | Fed. Rep. of Germany | 361/103 |
| 52-9988 | 1/1977 | Japan | 315/291 |

OTHER PUBLICATIONS

Silicon General "Application Notes-SG1524", pp. 136-142, (undated).

*Primary Examiner*—Eugene R. LaRoche
*Attorney, Agent, or Firm*—Pollock, Vande Sande & Priddy

[57] ABSTRACT

An energy-efficient ballast or energizing circuit for fluorescent lamps which is relatively uncomplicated and which can be manufactured relatively simply and inexpensively. An on-off switch and dimming means are connected in a low-voltage portion of the circuitry to permit less expensive wiring to be utilized. A base-driven, high frequency push-pull transistorized inverter circuit is utilized for energizing the lamps. The inverter drive is pulse width modulated to effect dimming, and to save energy additional transistor circuitry is provided for ensuring rapid turn-on and turn-off of the inverter transistors. A photo-responsive means senses ambient light and lamp light at a surface being illuminated by both and controls pulse width in accordance therewith. Thermostat means are mounted on the heat sinks of the inverter transistors and are connected in parallel with the on-off switch to effect shut-off if overheating occurs.

5 Claims, 2 Drawing Figures

PULSE WIDTH MODULATED DIMMING ARRANGEMENT FOR FLUORESCENT LAMPS

This is a continuation-in-part of application Ser. No. 247,314, filed Mar. 25, 1981, abandoned.

FIELD OF THE INVENTION

The present invention is directed to a pulse width modulator dimming ballast or energizing circuit for fluorescent lamps, and particularly to an energizing circuit which is relatively energy-efficient, and cost-competitive to manufacture.

BACKGROUND OF THE INVENTION

The prior art discloses a variety of pulse width modulator schemes for energizing gaseous discharge lamps. For example, in Dragoset U.S. Pat. No. 4,039,897, the conduction angle of 60 cycle A.C. is varied to maintain a preset power level by time integrating the difference between the circuit output signal multiplied by a multiplier factor and a reference signal. In Schmutzer et al, U.S. Pat. No. 4,132,925 the switching time of a series pass transistor is controlled to provide a pulse width modulated chopped D.C. signal for energizing a lamp. In Holmes U.S. Pat. No. 4,170,747, two transistor pairs are utilized to provide a high frequency variable duty cycle energization signal to a high intensity discharge (HID) lamp. In Japanese Kokai No. 52-988, a high frequency, pulse width modulated push-pull transistorized inverter is used for lamp energization.

While the prior art teaches a diversity of approaches for energizing gaseous discharge lamps, the present invention is directed to circuitry for advantageously energizing fluorescent lamps in an energy-efficient manner. The circuitry of the invention provides a dimming capability which can be operated either manually or automatically as well as controls which are connected in a low voltage portion of the circuitry, thus permitting the use of less expensive low voltage control wiring.

BRIEF SUMMARY OF THE INVENTION

It is therefore an object of the invention to provide an energy-efficient ballast or energizing circuit for fluorescent lamps.

It is a further object of the invention to provide an energizing circuit for fluorescent lamps which includes photo-responsive means for controlling lamp output in accordance with ambient light.

It is still a further object of the invention to provide an energizing circuit for fluorescent lamps which includes photo-responsive means for controlling lamp output in accordance with total light at a surface being illuminated.

It is still a further object of the invention to provide a lamp energizing circuit utilizing an on-off switch which is connected in a low voltage portion of the circuit, thus facilitating the use of relatively inexpensive low voltage wiring for on-off switches in the building in which the lamps are installed.

It is still a further object of the invention to provide a transistorized lamp energizing circuit which employs heat responsive means mounted on certain transistors for automatically shutting off the circuit when the transistors get too hot.

The above objects are achieved by providing a high frequency push-pull transistorized inverter circuit for energizing the lamps. The inverter provides pulses of alternating polarity to the primary of a transformer which couples the lamp or lamps, and to effect dimming, the inverter is pulse width modulated to control the level of power which is applied to the lamps. The width of the pulses may be controlled either manually by adjusting the potentiometer, or automatically by the use of a phototransistor or other photodetector.

In accordance with an aspect of the invention, the phototransistor is arranged to be responsive to ambient light plus lamp light at the surface being illuminated. Thus, as ambient light increases, lamp output decreases, so that maximum energy savings and relatively constant illumination levels are achieved.

The circuit is arranged so that the on-off switch is located in a low voltage portion of the circuitry. This permits low voltage wiring to be used for the on-off switches throughout the building in which the energizing circuits are installed, resulting in substantially reduced cost.

A further circuit feature utilized is thermostat means which are mounted on the heat sinks which encase the inverter transistors. The thermostat means are connected to the above-mentioned on-off switch to automatically shut the circuit off if the transistors should begin to overheat.

BRIEF DESCRIPTION OF THE DRAWINGS

The invention will be better understood by referring to the accompanying drawings, in which.

DETAILED DESCRIPTION OF AN ILLUSTRATIVE EMBODIMENT

Figure 1:
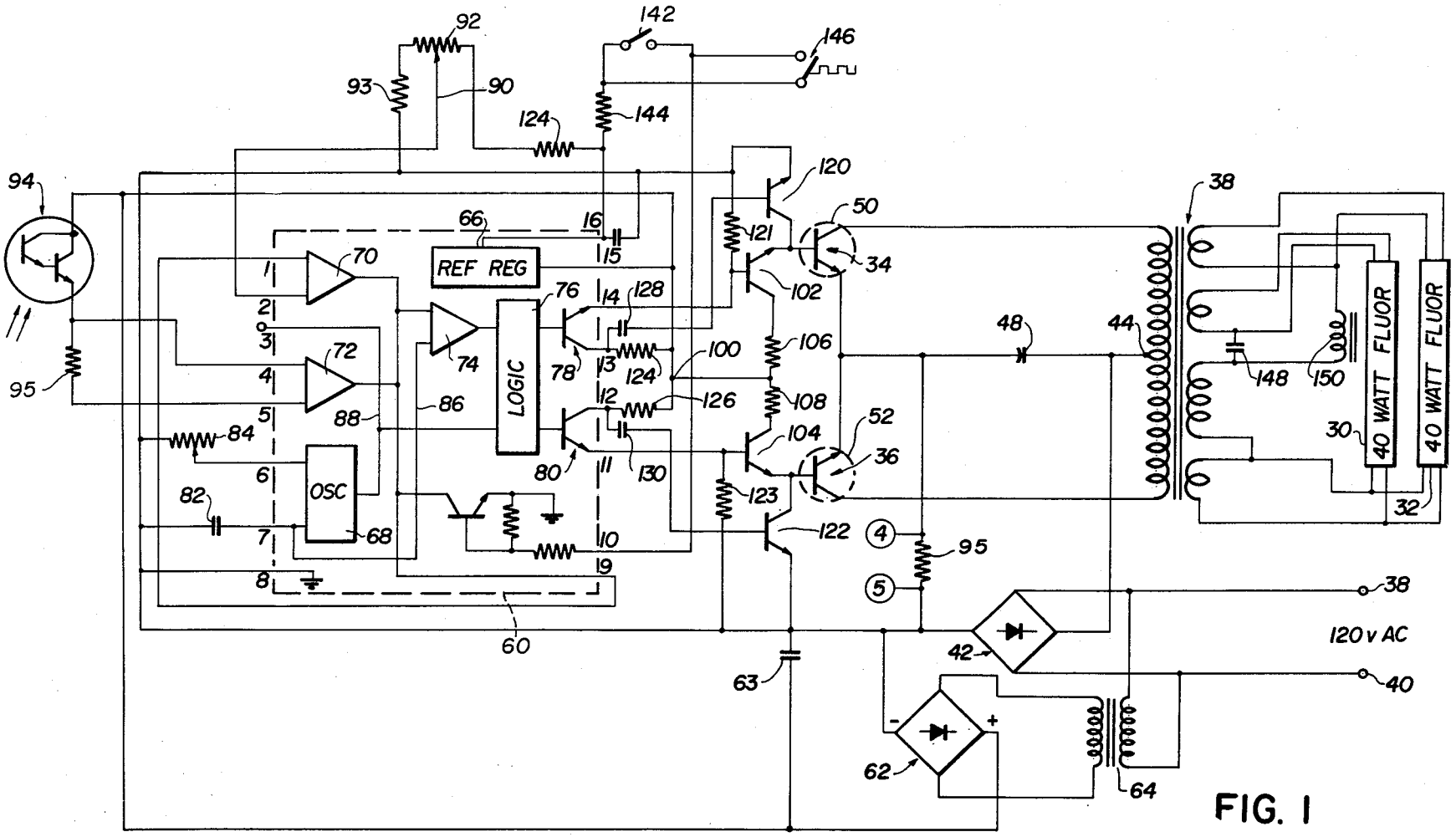
FIG. 1 is a schematic diagram of an illustrative embodiment of the invention.

Referring to FIG. 1, fluorescent lamps 30 and 32 are to be energized by the circuitry illustrated. In accordance with the invention, an inverter including transistors 34 and 36 which are operated in push-pull, provides pulses of alternating polarity to the primary of transformer 38, the secondary of which is connected to the lamps. The transistors of the inverter are base-driven and the pulses outputted thereby are pulse-width modulated by the width of the drive signals which are provided to the transistor bases.

Referring to the figure in greater detail, terminals 38 and 40 are connected to the 120 volt A.C. household supply which is inputted to full wave diode rectifying bridge 42, the output of which is connected between the center tap 44 of the transformer primary and the emitters of transistors 34 and 36. A rectified voltage of approximately 170 volts D.C. is supplied.

The inverter is comprised of power transistors 34 and 36, the primary of transformer 38, and capacitor 48. The emitters of the transistors are connected together, and the collectors are connected to opposite ends of the transformer primaries, while capacitor 48 is connected between the emitters and the transformer primary center tap 44. In the illustrative embodiment, transistors 34 and 36 are of the MJE 13003 type, and are mounted in heat sinks 50 and 52.

As mentioned, transistors 34 and 36 are driven in a push-pull mode, so that except for the dead time between transistor pulses, one of the transistors is always conducting. Thus, when transistor 34 conducts, a current pulse under a voltage of approximately 170 volts flows through the transistor in the direction of the emitter arrow, through capacitor 48, and upwardly in the drawing through the top-half of the transformer primary. When transistor 34 is off and transistor 36 conducts, a current pulse flows through transistor 36 in the direction of the emitter arrow, through capacitor 48, and downwardly in the drawing through the lower-half of the transformer primary. In the preferred embodiment of the invention, the transistors are pulsed at a relatively high frequency of approximately 25 khz to cause A.C. current pulses at this frequency to energize the transformer and excite the lamps. As is known, the use of high frequency A.C. results in increased fluorescent lamp efficiency.

The transistors of the inverter are driven by pulse width modulator circuitry, which may for instance be comprised of an integrated circuit such as the Silicon General SG 1524 regulating pulse width modulator in combination with external circuitry. The invention will be illustrated in conjunction with the SG 1524 circuit and pin numbers used shall refer to that unit, although it should be understood that any equivalent circuitry could be used.

The integrated circuit, denoted by reference numeral 60 in the Figure, is powered by the low voltage output (approximately 30 volts) of diode bridge 62 across which capacitor 63 is connected. The input of the diode bridge is connected to the 120 volts A.C. lines through step-down transformer 64. The D.C. output voltage of bridge 62 is connected to pin 15 of the integrated circuit, which connects with voltage regulator 66 while the regulated output is provided to the various functional units of the circuit from lines connected to pin 16.

The integrated circuit is comprised of voltage regulator 66 mentioned above, oscillator 68, error amplifier 70, current limiting circuit 72, comparator 74, logic circuitry 76, and output transistors 78 and 80. In the operation of the circuit, oscillator 68 is arranged to repetitively charge external capacitor 82 through variable resistor 84 thereby providing a ramp output on line 86. The oscillator also provides a pulse output on line 88 at the same repetition rate as the periodic ramp output on line 86. The frequency of oscillation of the oscillator is controlled by resistor 84 and capacitor 82, and may be adjusted by adjusting the resistance of variable resistor 84.

Error amplifier 70 is a differential input, transconductance amplifier, the input of which at pin 2 is connected to the slider 90 of dimming potentiometer 92. The output of amplifier 70 determines the width of the pulse width modulated output signals.

Current limiting circuit 72 while represented in the diagram as an op amp, actually is comprised of a single transistor amplifier which is frequency compensated and has a second transistor to provide temperature compensation and a reduction of input threshold to 200 mv. When this threshold is exceeded, the amplifier transistor turns on and, by pulling the output of the error amplifier towards ground, linearly decreases the output pulse width. The input to the current limiting circuitry at pins 4 and 5 is connected to current limiting resistor 95 to provide current limiting and, as described in greater detail below, to photo-amplifier 94, to provide responsive pulse-width adjustment.

The output of error amplifier 70 and the periodic ramp output of oscillator 68 on line 86 are connected to comparator 74 which emits an output signal when the ramp becomes equal to the magnitude of the error amplifier output. The output of comparator 74 as well as the pulse output of oscillator 68 are fed to logic circuitry 76, the function of which is to turn output transistors 78 and 80 alternately on for a period of time proportional to the magnitude of the output of error amplifier 70. Since the time which it takes the ramp to become equal to the error magnitude determines the time when comparator 74 goes high, this time is used as a measure of pulse width.

In the SG 1524 integrated circuit, logic circuitry 76 is comprised of a flip-flop having the high output of one stage connected to the input of a first NOR gate and the high output of the other stage connected to one of the inputs of a second NOR gate. The pulse output of the oscillator is connected to the input of the flip-flop and is also connected directly to a second input terminal of both NOR gates while the output of comparator 74 is connected to a third input of both NOR gates. The outputs of the first and second NOR gates are connected respectively to the bases of output transistors 78 and 80.

Referring to the circuitry external to integrated circuit 60, the positive side of rectifying bridge 62 is connected to terminal 100. Transistors 102 and 104 are connected to this voltage through resistors 106 and 108 respectively, and function to provide a base drive for the inverter transistors which is of greater magnitude than can be provided by integrated circuit output transistors 78 and 80. Thus, the emitters of transistors 78 and 80 are connected-to the bases of transistors 102 and 104 respectively, and when output transistor 78 turns on, it causes transistors 102 to conduct which drives inverter transistor 34. Similarly, when output transistor 80 turns on, it causes transistor 104 to conduct which drives inverter transistor 36.

Transistors 120 and 122 are provided to ensure a rapid turn-off of inverter transistors 34 and 36. That is, the turning off of integrated circuit output transistors 78 and 80 in the absence of additional circuitry, will not result in immediate turn-off of the inverter transistors, since the transistors must pass through a transistional resistive state before they are fully off. The purpose of transistors 120 and 122 is to provide reverse base current to the inverter transistors 34 and 36. This is necessary to quickly remove carriers from the base region at turn-off of transistors 34 and 36 thus resulting in a more rapid passage through the resistive state. At the moment transistor 78 stops conducting, current passes through resistor 124 and charges capacitor 128 which immediately discharges and turns transistor 120 on, causing current to be pulled away from the base of inverter transistor 34. Transistor 122 works in a similar fashion to result in more rapid turn-off of inverter transistor 36.

As mentioned above, the fluorescent lamps may be dimmed by adjusting the position of wiper 90 of dimming potentiometer 92. Pin 16, the voltage regulator output, is connected to the error amplifier 70 through resistor 124 and a variable resistance portion of potentiometer 92.

Thus, as the wiper is moved, the output of the error amplifier varies as does the pulse width of the pulses provided by output transistors 78 and 80. Consequently, the pulse widths of the inverter output pulses are varied in accordance with the potentiometer setting. The pulse widths are adjusted so that there is always a dead time between consecutive pulses outputted by transistors 34 and 36, which provides room for pulse width expansion and contraction. Resistor 95 is connected in the current return diode bridge 42 and the voltage thereacross may be fed back through pins 4 and 5 of the integrated circuit to op amp 72 to provide automatic narrowing of pulses if the output current becomes greater than a predetermined maximum.

In accordance with an aspect of the invention photo-responsive means 94 is provided to attain pulse width adjustment in response to ambient light level. In the preferred embodiment the photo-responsive means is a phototransistor connected with a second transistor in Darlington configuration, and is referred to herein as a photo-amplifier.

Figure 2:
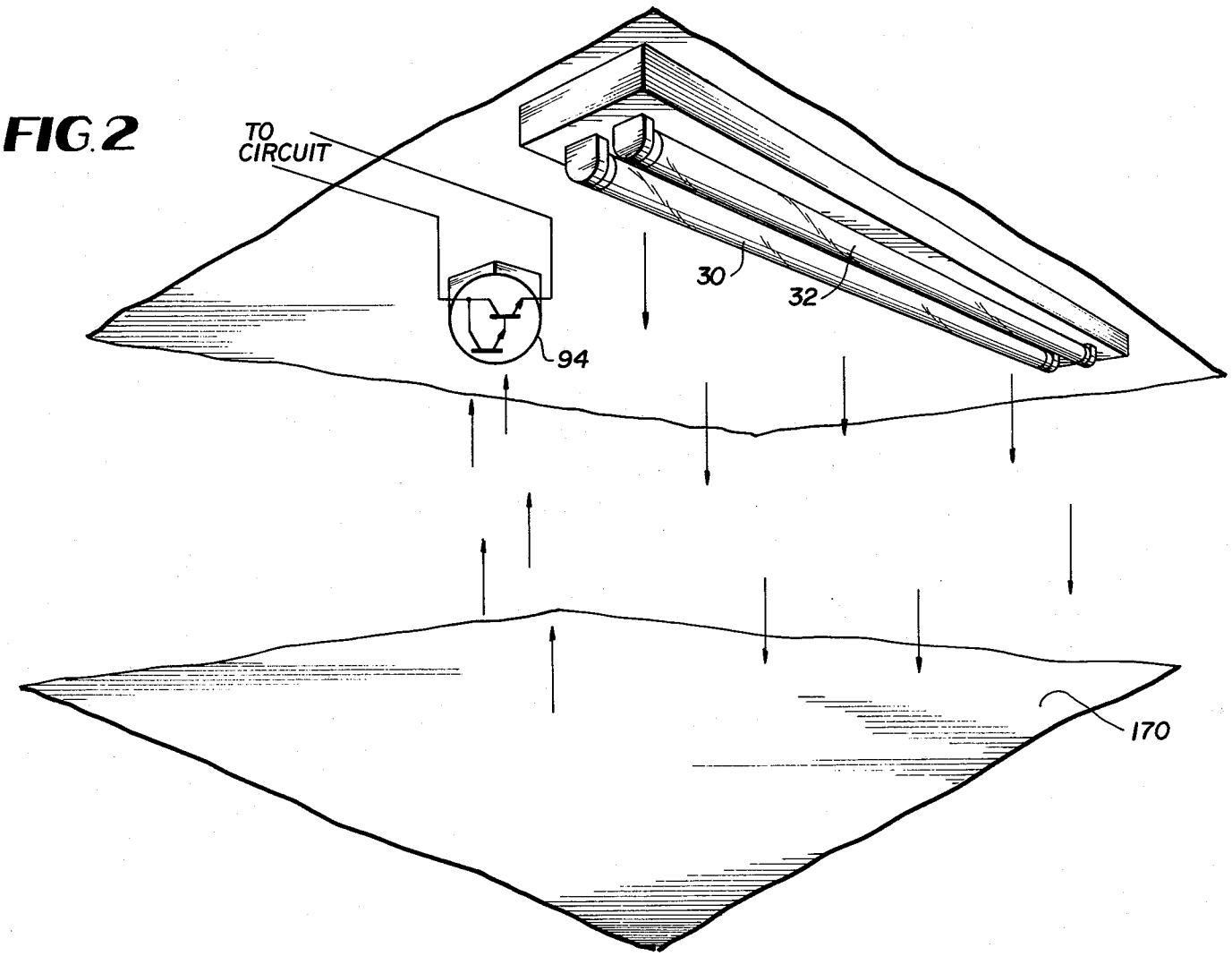
FIG. 2 is a pictorial representation illustrating a photo-amplifier which is part of the energizing circuit of the invention and its positional relationship to a surface being illuminated.

Referring to FIG. 2, the disposition of photo-amplifier 94 in relation to a surface being illuminated is illustrated. In the Figure, surface 170 is illuminated by fluorescent lamps 30 and 32 which are excited by the circuitry illustrated in FIG. 1, and also by ambient light. Photo-amplifier 94 is mounted at the same ceiling surface as the fluorescent lamps, and is directed towards the surface being illuminated so that ambient light and lamp light reflected from the surface is incident thereon. Of course, the photo-amplifier may be mounted elsewhere, such as on a wall, so long as it is directed towards the surface being illuminated.

Potentiometer wiper 90 is adjusted initially so that lamps 30 and 32 provide suitable illumination with no ambient light present. Then, during operation, photo-amplifier 94 is effective to reduce the lamp output in correspondence with the intensity of the light which is incident on it. This results in energy savings, and is effective to maintain a relatively constant level of illumination on surface 170. Directing the photo-amplifier towards the surface being illuminated, for example a desk in an office is more effective than directing it towards a window, since light coming in a window is not necessarily a good indication of light which is incident on the surface being illuminated.

In accordance with a further aspect of the invention, the on-off switch for lamps 30 and 32 is connected in a low voltage portion of the circuit. In FIG. 1, on-off switch 142 is connected between resistor 144 and pin 10 of the integrated circuit. The on-off switch 142 would typically be a wall-mounted switch which is located remotely from the lamps, and connecting such switches in the low voltage part of the circuit permits lower cost relatively low current rated wire to be used for connecting switches, than if they were connected directly to the fluorescent lamps. When the wiring of an entire building is considered, a substantial savings in cost results from this arrangement.

Referring to FIG. 1, it will be noted that inverter transistors 34 and 36 are mounted in heat sinks 50 and 52, and thermostats 146 (only one illustrated) are mounted on the heat sinks. As shown in the Figure, the thermostats are connected in parallel to the on-off switch to automatically turn the circuit off if the transistors overheat.

Capacitor 148 and inductor 150 are provided at the fluorescent lamps to transform the negative operating impedance of the lamps to a positive resistive value. Since a fluorescent lamp is a plasma discharge device, it has a negative operating impedance, and unless a greater positive impedance is placed in series with it, it would draw uncontrolled current and damage itself. Since it is desirable that the positive impedance does not dissipate significant power, a reactive impedance is used. The reactive impedance stores current during part of the cycle and releases it during the remainder of the cycle and since power is not dissipated but only stored, a "watt-less" ballasting means is provided. In the circuitry shown in the drawing, lamp 32 is ballasted with inductor 150, while lamp 30 is ballasted with a capacitor 148. The values are chosen so that, at the operating frequency of the inverter, the capacitive reactance balances out the inductive reactance, thereby transforming the impedance of the lamps to a positive resistive value which results in a minimum secondary current in transformer 38. To compensate for manufacturing tolerances in the values of capacitor 148 and inductor 150, the output frequency of the inverter may be adjusted with variable resistor 84.

There thus has been described an energy-efficient energizing circuit for fluorescent lamps. It should be understood that while I have described certain embodiments of the invention, I do not intend to be restricted thereto, but rather intend to cover all variations and modifications which come within the spirit of the invention, which is limited only by the claims which are appended hereto.

What is claimed is:

1. A relatively high efficiency, adjustable pulse width modulator energizing circuit for a fluorescent lamp for illuminating a surface which is also illuminated by ambient light, comprising:

a transformer having a primary winding, and a secondary winding for connection to said fluorescent lamp;

transistorized push-pull inverter means connected to said primary winding of said transformer for providing pulses of alternating polarity thereto when driven, pulse width modulator drive means for driving said inverter means with drive pulses at a relatively high frequency;

means for adjusting the width of said drive pulses to control the power which is applied to said fluorescent lamp;

said means for adjusting the width of said drive pulses including photo-responsive control means directed at said surface for sensing ambient light and florescent lamp light reflected from said surface.

2. The circuit of claim 1, wherein the transistors of said inverter are mounted in heat sinks, and wherein thermostat means are mounted on one or more of said heat sinks, said thermostat means being connected in parallel with an on-off switch for shutting the circuit off when the transistors overheat.

3. The circuit of claim 2, wherein said circuit is comprised of a high voltage portion including said inverter, said transformer and said lamp and a low voltage portion including said pulse width modulator drive means, and said on-off switch is connected in said low voltage portion of said circuit for controlling said lamp.

4. A relatively high efficiency, adjustable pulse width modulator energizing circuit for a fluorescent lamp for providing variable power at a high frequency to said lamp, comprising:

an on-off switch;

a transformer having a primary winding, and a secondary winding for connection to said fluorescent lamp;

transistorized push-pull inverter means connected to said primary winding of said transformer for providing pulses of alternating polarity thereto when driven;

pulse width modulated drive means for driving said inverter means with drive pulses at a relatively high frequency;

means for adjusting the width of said drive pulses to control the power which is applied to said fluorescent lamp; and the transistors of said inverter being mounted in heat sinks, and thermostat means being mounted on one or more of said heat sinks, said thermostat means being connected in parallel with said on-off switch for controlling said pulse width modulated drive means for shutting the circuit off when transistors overheat.

5. A relatively high efficiency, adjustable pulse width modulator energizing circuit for a fluorescent lamp for illuminating a surface which is also illuminated by ambient light, comprising:

an on-off switch;

a transformer having a primary winding, and a secondary winding for connection to said fluorescent lamp;

transistorized push-pull inverter means connected to said primary winding of said transformer for providing pulses of alternating polarity thereto when driven;

pulse width modulated drive means for driving said inverter means with drive pulses at a relatively high frequency;

means for ajusting the width of said drive pulses to control the power which is applied to said fluorescent lamp; and said means for adjusting the width of said drive pulses including photo-responsive control means for sensing ambient light and fluorescent lamp light at said surface;

the transistors of said inverter being mounted in heat sinks, and thermostat means being mounted on one or more of said heat sinks, said thermostat means being connected in parallel with said on-off switch for controlling said pulse width modulator drive means for shutting the circuit off when the transistors overheat.

* * * * *